US010941014B2

(12) United States Patent
Nilsson

(10) Patent No.: US 10,941,014 B2
(45) Date of Patent: Mar. 9, 2021

(54) PLASTIC CAP FOR A CABLE SPOOL

(71) Applicant: Axjo Plastic Aktiebolag, Gislaved (SE)

(72) Inventor: Jacob Nilsson, Anderstorp (SE)

(73) Assignee: AXJO PLASTIC AKTIEBOLAG, Gislaved (SE)

( * ) Notice: Subject to any disclaimer, the term of this patent is extended or adjusted under 35 U.S.C. 154(b) by 88 days.

(21) Appl. No.: 16/317,199

(22) PCT Filed: Jul. 11, 2017

(86) PCT No.: PCT/EP2017/067328
§ 371 (c)(1),
(2) Date: Jan. 11, 2019

(87) PCT Pub. No.: WO2018/015204
PCT Pub. Date: Jan. 25, 2018

(65) Prior Publication Data

US 2019/0300326 A1 Oct. 3, 2019

(30) Foreign Application Priority Data

Jul. 19, 2016 (EP) ..... 16180138

(51) Int. Cl.
*B65H 75/18* (2006.01)
*B65H 75/14* (2006.01)

(52) U.S. Cl.
CPC ..... *B65H 75/187* (2013.01); *B65H 75/14* (2013.01); *B65H 75/182* (2013.01)

(58) Field of Classification Search
CPC .... B65H 75/14; B65H 75/182; B65H 75/185; B65H 75/187
See application file for complete search history.

(56) References Cited

U.S. PATENT DOCUMENTS 1,670,454 A 5/1928 Kohani
2,190,085 A 2/1940 Scholl
(Continued)

FOREIGN PATENT DOCUMENTS

DE 8811272 U1 10/1988
GB 2293225 A 3/1996
(Continued)

OTHER PUBLICATIONS

Extended European Search Report issued in corresponding EP Application No. 19199517.4, dated Dec. 10, 2019, pp. 1-7.
(Continued)

*Primary Examiner* — William E Dondero
(74) *Attorney, Agent, or Firm* — Murtha Cullina LLP

(57) ABSTRACT

A cap to be used with a plastic cable spool, said cap including a back side adapted to be arranged towards a barrel of a plastic cable spool and a front side adapted to be directed away from a barrel of a plastic cable spool, wherein said cap has a through-hole adapted to be aligned with a center axis of a cable spool, wherein said through-hole is at least partly surrounded by an inner wall on the back side of said cap, wherein said cap is provided with an outer wall extending around at least a part of said outer circumference of said cap, on the back side of said cap, and wherein said back side of said cap is provided with at least four reinforcement ribs extending between said outer wall and said inner wall.
A cable spool being provided with such a cap.

13 Claims, 3 Drawing Sheets

(56) References Cited

U.S. PATENT DOCUMENTS

| | | | | |
|---|---|---|---|---|
| 3,334,841 | A | 8/1967 | Burhop | |
| 3,567,146 | A | 3/1971 | Arenson | |
| 3,627,220 | A | 12/1971 | Vogel | |
| 5,718,397 | A | 2/1998 | Stevens | |
| 6,305,639 | B1 | 10/2001 | Bocciola | |
| 6,398,154 | B1 | 6/2002 | Cox et al. | |
| 2002/0148925 | A1* | 10/2002 | Cox | B65H 75/14 242/608.6 |
| 2008/0061187 | A1 | 3/2008 | Couchey et al. | |
| 2010/0261592 | A1 | 10/2010 | Wu | |

FOREIGN PATENT DOCUMENTS

| | | | |
|---|---|---|---|
| GB | 2362375 | A | 11/2001 |
| WO | 9907631 | A1 | 2/1999 |

OTHER PUBLICATIONS

International Search Report and Written Opinion issued in corresponding PCT Application No. PCT/EP201 7/067328, dated Sep. 12, 2017, pp. 1-14.

* cited by examiner

PLASTIC CAP FOR A CABLE SPOOL

TECHNICAL FIELD OF THE INVENTION

The present invention relates to a plastic cap for a cable spool. It also relates to a cable spool being provided with a plastic cap.

BACKGROUND OF THE INVENTION

Different kinds of cable spools are being used for carrying and transporting various types of cables and wires, such as electric cables, fiber optic cables and wire products. Cable spools can be made of e.g. wood, plywod, steel and plastic.

Plastic cable spools may be produced in many different manners, e.g. by producing parts that are thereafter snap-fitted, welded or glued together. In order to provide for a stronger and more durable product, it is desirable to produce as much as possible of the product in one piece. That may for example be achieved by producing the plastic spools by molding, for example by injection molding. When forming spools by injection molding, the product is during production held around at least one core extending into the plastic spool in order to produce an internal cavity therein. During use of the spool, the internal cavity may receive a shaft of a machine, and the spool may thereby be made to rotate around the shaft. It is therefor common that the molding core is provided in the barrel of the cable spool. Once, the plastic spool is molded, the molding core may be removed. In order to be able to remove the molding core, an opening having a least the same diameter as the molding core, and thereby the same diameter as the inner diameter of the barrel, must be provided at one of the flanges of the plastic spool. As it is often not desirable to have such a large opening into the core, the hole may be plugged by a plastic cap.

The plastic cap may be snap-fitted into the barrel. When the cable spool is being used, it is nowadays often handled by robots in automated processes. It is therefore a general need for providing plastic caps for cable spools that are able to be handled in automated process. It is also a further desire to provide plastic caps that are able to simplify and improve the automated processes of handling cable spools.

SUMMARY OF THE INVENTION

An object of the present invention is to provide a plastic cap for cable spools that overcomes the above issues.

According to a first aspect of the present invention, a cap to be used with a plastic cable spool is provided. Said cap comprising a back side adapted to be arranged towards a barrel of a plastic cable spool and a front side adapted to be directed away from a barrel of a plastic cable spool, wherein said cap has a through-hole adapted to be aligned with a center axis of a cable spool, wherein said through-hole is at least partly surrounded by an inner wall on the back side of said cap, wherein said cap is provided with an outer wall extending around at least a part of said outer circumference of said cap, on the back side of said cap, and wherein said back side of said cap is provided with at least four reinforcement ribs extending between said outer wall and said inner wall.

A cap according to the first aspect of the present invention fulfills the needs of being able to be handled in automated processes. The reinforcement ribs improve the stability of the cap and make it less flexible. Thereby, the cap is less prone to bend in an undesired manner when being handled by robots and winding machines.

According to one exemplary embodiment, the cap is provided with at least six reinforcement ribs. According to another exemplary embodiment, the cap is provided with at least eight reinforcement ribs.

According to one exemplary embodiment, the height of said reinforcement ribs is uniform throughout their extension between said outer wall and said inner wall. Providing a uniform height of said reinforcement ribs have proven to be beneficial in terms of increased stability of the cap.

According to one exemplary embodiment, the height of said outer wall and the height of said inner wall is the same as the height of said reinforcement ribs. By this, the stability is increased even further.

According to one exemplary embodiment, the height of said reinforcement ribs are in the range of 30-70 mm, more preferably 40-60 mm, and most preferably 45-55 mm.

According to one exemplary embodiment, the height of all reinforcement ribs except one is the same as the height of said outer wall and the height of said inner wall. It may in certain embodiments be desired to provide one rib having a lower height than the others.

According to one exemplary embodiment, one of the reinforcement ribs are intersected by a trough-hole, extending through the flange of the cable spool. Such a through-hole may e.g. serve as a drive hole when said cable spool is utilized in a winding machine.

According to one exemplary embodiment, said through-hole is surrounded by a second inner wall, wherein said second inner wall has the same height as the reinforcement rib the trough-hole intersects.

According to one exemplary embodiment, the outer wall extends along the entire circumference of the cap. An un-interrupted outer wall gives better strength and stability of the cap, as compared to an embodiment in which the outer wall is not provided along the entire circumference of the cap.

According to one exemplary embodiment, the inner wall extends along the entire centrally provided through-hole.

According to one exemplary embodiment, the cap is provided with integral attachment means adapted for snap-fitting the plastic cap to a cable spool. Providing integral attachment means for snap-fitting the plastic cap to the cable spool is a beneficial manner in attaching the two components to each other.

According to one exemplary embodiment, the cap is provided with four integral attachment means.

According to one exemplary embodiment, the cap is provided with a rotational lock adapted for rotationally locking said cap in relation to a cable spool. It is important for the automated handling of cable spools that the plastic cap is held in its desired position and orientation to the cable spool. Maintaining the desired orientation may be achieved by providing a rotational lock.

According to one exemplary embodiment, the rotational lock is a separate component from the integral attachment means. Hence, according to this exemplary embodiment, at least one specific integral attachment means is provided and at least one specific rotational lock is provided.

According to one exemplary embodiment, the rotational lock is provided on a flange extending outside said outer wall of said cap. Providing the rotational lock at a flange extending outside the outer wall of said cap increases the distance between the rotational lock and the center of the cap. This is advantageous as it provides a more stable rotational lock.

As is clear from the above, the outer wall of the cap may extend along the entire circumference of the cap, and the flanges are provided outside the outer wall.

According to one exemplary embodiment, the distance between the rotational lock and the center of the through-hole of the cap is between 5 and 9 cm, more preferably 6 and 8 cm and most preferably 6.5 and 7.5 cm. These distances have proven to be beneficial as they provides both good rotational locking while at the same time fits at the flange of the cable spool without compromising other features provided thereon.

According to one exemplary embodiment, the cap is provided with two rotational locks, provided on a respective flange at diametrically opposed sides of said cap. Providing two rotational locks gives even better protection against undesired rotation of the cap in relation to the cable spool.

According to one exemplary embodiment, the distance between each one of the rotational locks and the center of the through-hole of the cap is between 5 and 9 cm, more preferably 6 and 8 cm and most preferably 6.5 and 7.5 cm.

According to one exemplary embodiment, the cap has a generally circular outline, and is provided with two diametrically opposed concave recesses. The recesses extend in a plane perpendicular to the front and back side of the cap. Hence, when the cap is viewed from e.g. its front side, the recesses extend towards the center of cap. The purpose of the concave recesses is to provide start holes for the cable spool. Hence, the concave recesses are to be aligned with through-holes of the flange of the cable spool. With these concave recesses, which have the outer wall extending along the circumference thereof, the start holes of the cable spool are reinforced. This provides for a stronger and more durable cable spool.

With generally circular outline is meant to understand the cap, excluding the one or two flanges on which rotational locks are provided, in the embodiments where such flanges are present.

According to one exemplary embodiment, the concave recesses each has a distance in the range of 4-7 cm and more preferably between 5 and 6 cm between its edges. Recesses of this size are suitable for use as start holes of a cable spool.

According to one exemplary embodiment, the through-hole of said plastic cap is, on the front side of said cap, surrounded by an area provided with means for enabling identification of the cap by a vision camera.

Vision cameras may be used by robots for finding and identifying e.g. cable spools in automated processes. It is therefore beneficial to provide means for enabling the identification of the cap, and thereby the cable spool that the cap is attached to, on the cap. It is also beneficial to provide the area with such means so that it surrounds the through-hole of the plastic cap as it is common that e.g. a robot uses the through-hole for holding and lifting the cable spool.

According to one exemplary embodiment, said means for enabling identification of the cap by a vision camera is either a color differing from the color of the remaining cap or a surface structure differing from the surface structure of the remaining cap or a pattern differing from the pattern of the remaining cap, or a combination of either two or three of the different color, surface structure and pattern. However, it is not necessary that the entire remaining parts of the cap have the same pattern, surface structure and/or color. It is sufficient if the means for enabling identification of the vision camera is sufficiently distinct to allow e.g. a robot to identify the plastic cap and its position.

According to one exemplary embodiment, the surface structure may be different by changing its roughness, as compared to the roughness of the surface of the remaining parts of the cap.

According to a second aspect of the present invention, a cable spool comprising a barrel and two flanges is provided. According to the second aspect of the present invention, one of said flanges of the cable spool is provided with a cap according to the first aspect of the present invention.

According to one exemplary embodiment, both flanges of the cable spool are provided with a cap according to the first aspect of the present invention.

It is quite common that a divided core is used when the cable spool is produced by molding. Hence, in that case, there are openings at both sides of the cable spool from the molding core and it may therefore be beneficial to provide both sides with a cap.

According to one exemplary embodiment, said cable spool is made in one piece. Hence, the entire cable spool, except for the plastic cap or plastic caps, is made in one piece. Producing the entire cable spool in one piece gives a cable spool that is stronger and more durable than cable spools that have been produced in e.g. three separate pieces, such as two flanges and one barrel, and thereafter glued or welded together. Furthermore, producing the cable spool in one piece is beneficial as it provides for a less labor-intensive production.

According to one exemplary embodiment, said cable spool is produced by injection molding.

According to one exemplary embodiment, said barrel is provided with a through-hole, wherein said through-hole is provided at such a distance from one of the flanges of the cable spool being provided with said cap, that the part of the through-hole being closest to the flange is flush with the outermost part of the outer wall of said cap. It may be beneficial to provide the cable spool with through-holes also at the barrel. These trough-holes may serve as start holes in certain types of winding machines. By providing an outer wall of the cap with such a height that the start hole of the barrel is flush with the outer edge of the outer wall, the barrel is internally reinforced by the outer wall from the flange and up to the start hole. This is beneficial as it provides for a stronger and more durable cable spool.

According to a third aspect of the present invention, a cap to be used with a plastic cable spool is provided. Said cap comprising a back side adapted to be arranged towards a barrel of a plastic cable spool and a front side adapted to be directed away from a barrel of a plastic cable spool, wherein said cap has a through-hole adapted to be aligned with a center axis of a cable spool, and wherein the through-hole of said plastic cap is, on the front side of said cap, surrounded by an area provided with means for enabling identification of the cap by a vision camera.

Vision cameras may be used by robots for finding and identifying e.g. cable spools in automated processes. It is therefore beneficial to provide means for enabling the identification of the cap, and thereby the cable spool that the cap is attached to, on the cap. It is also beneficial to provide the area with such means so that it surrounds the through-hole of the plastic cap as it is common that e.g. a robot uses the through-hole for holding and lifting the cable spool.

According to one exemplary embodiment, said means for enabling identification of the cap by a vision camera is either a color differing from the color of the remaining cap or a surface structure differing from the surface structure of the remaining cap or a pattern differing from the pattern of the remaining cap, or a combination of either two or three of the different color, surface structure and pattern. However, it is not necessary that the entire remaining parts of the cap have the same pattern, surface structure and/or color. It is sufficient if the means for enabling identification of the vision camera is sufficiently distinct to allow e.g. a robot to identify the plastic cap and its position.

According to one exemplary embodiment, the surface structure may be different by changing its roughness, as compared to the roughness of the surface of the remaining parts of the cap.

The plastic cap according to the third aspect of the present invention may be provided with any of the features of the different embodiments of the first aspect of the present invention. The advantages described above for any of these features are also valid for the third aspect of the present invention. The plastic cap according to the third aspect of the present invention may be used together with a cable spool according to the second aspect of the present invention.

According to a fourth aspect of the present invention, a cap to be used with a plastic cable spool is provided. Said cap comprising a back side adapted to be arranged towards a barrel of a plastic cable spool and a front side adapted to be directed away from a barrel of a plastic cable spool, and wherein the cap is provided with a rotational lock adapted for rotationally locking said cap in relation to a cable spool. It is important for the automated handling of cable spools that the plastic cap is held in its desired position and orientation to the cable spool. Maintaining the desired orientation may be achieved by providing a rotational lock.

According to one exemplary embodiment, the rotational lock is provided on a flange extending outside said outer wall of said cap. Providing the rotational lock at a flange extending outside the outer wall of said cap increases the distance between the rotational lock and the center of the cap. This is advantageous as it provides a more stable rotational lock.

According to one exemplary embodiment, the distance between the rotational lock and the center of the through-hole of the cap is between 5 and 9 cm, more preferably 6 and 8 cm and most preferably 6.5 and 7.5 cm. These distances have proven to be beneficial as they provides both good rotational locking while at the same time fits at the flange of the cable spool without compromising other features provided thereon.

According to one exemplary embodiment, the cap is provided with two rotational locks, provided on a respective flange at diametrically opposed sides of said cap. Providing two rotational locks gives even better protection against undesired rotation of the cap in relation to the cable spool.

According to one exemplary embodiment, the distance between each one of the rotational locks and the center of the through-hole of the cap is between 5 and 9 cm, more preferably 6 and 8 cm and most preferably 6.5 and 7.5 cm.

The plastic cap according to the fourth aspect of the present invention may be provided with any of the features of the different embodiments of the first and third aspects of the present invention. The advantages described above for any of these features are also valid for the fourth aspect of the present invention. The plastic cap according to the fourth aspect of the present invention may be used together with a cable spool according to the second aspect of the present invention.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION

An embodiment of the invention will be described in more detail in the following with reference to the accompanying drawings.

Figure 1:
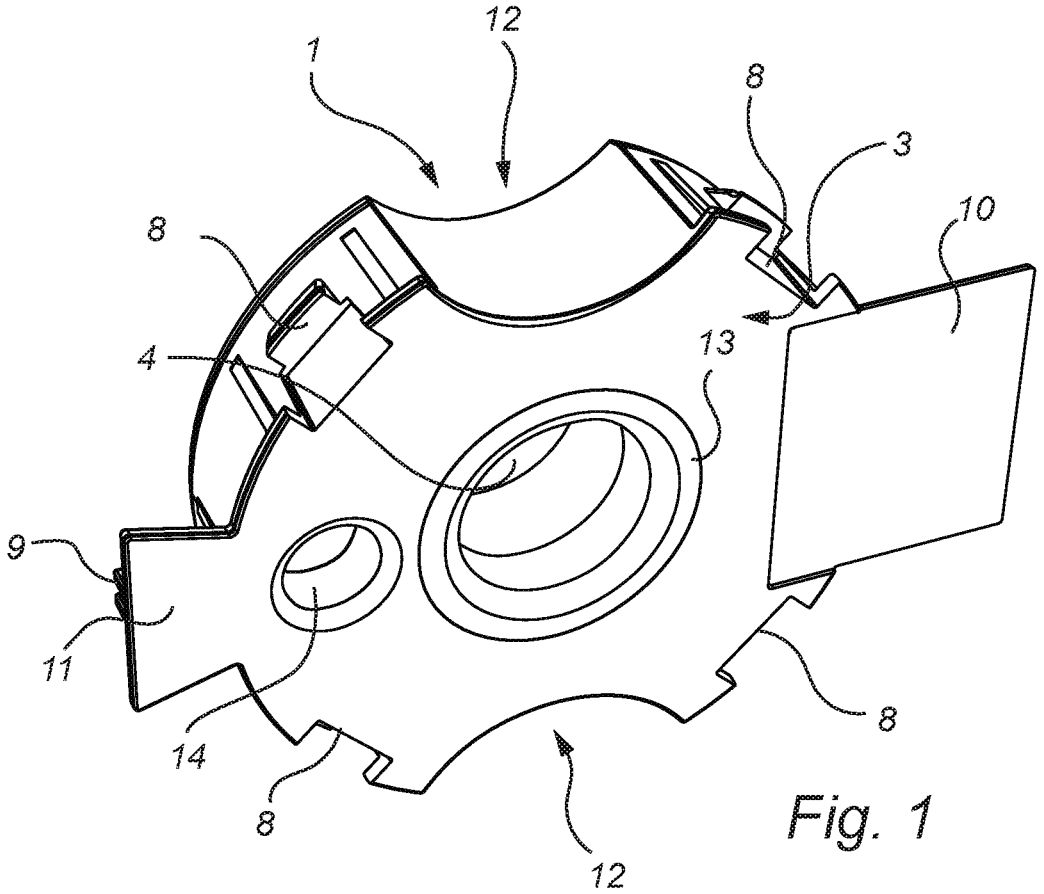
FIG. 1 illustrates a plastic cap for a cable spool, seen in perspective view from the front side of the plastic cap.
Figure 2:
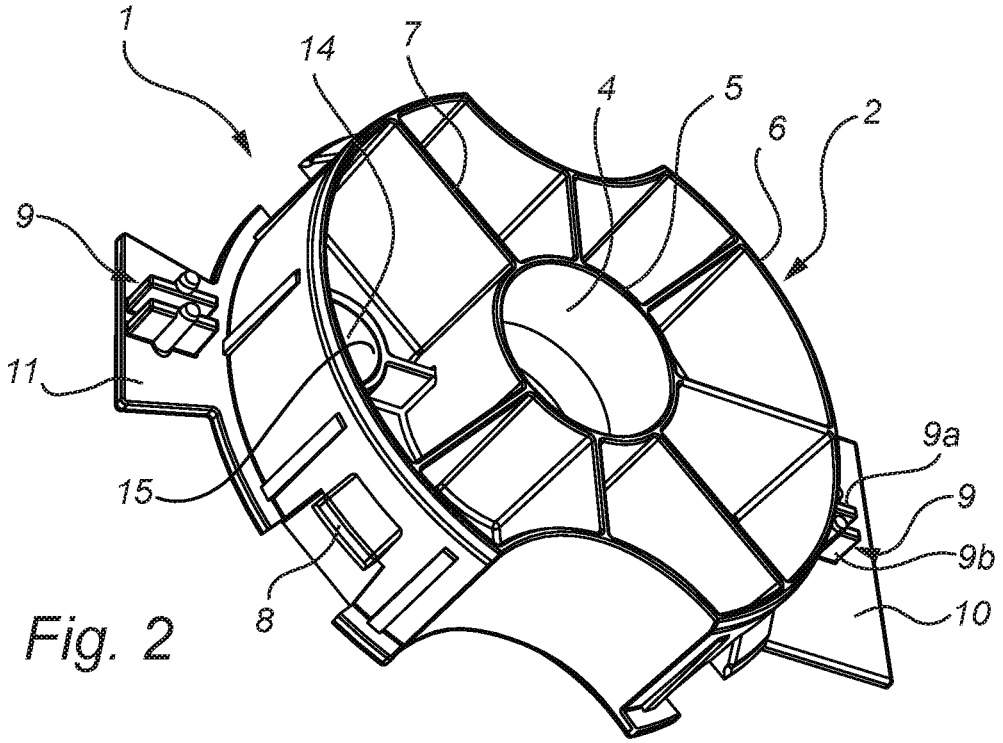
FIG. 2 illustrates the plastic cap for a cable spool in FIG. 1, but seen in perspective view from the back side of the plastic cap.
Figure 3:
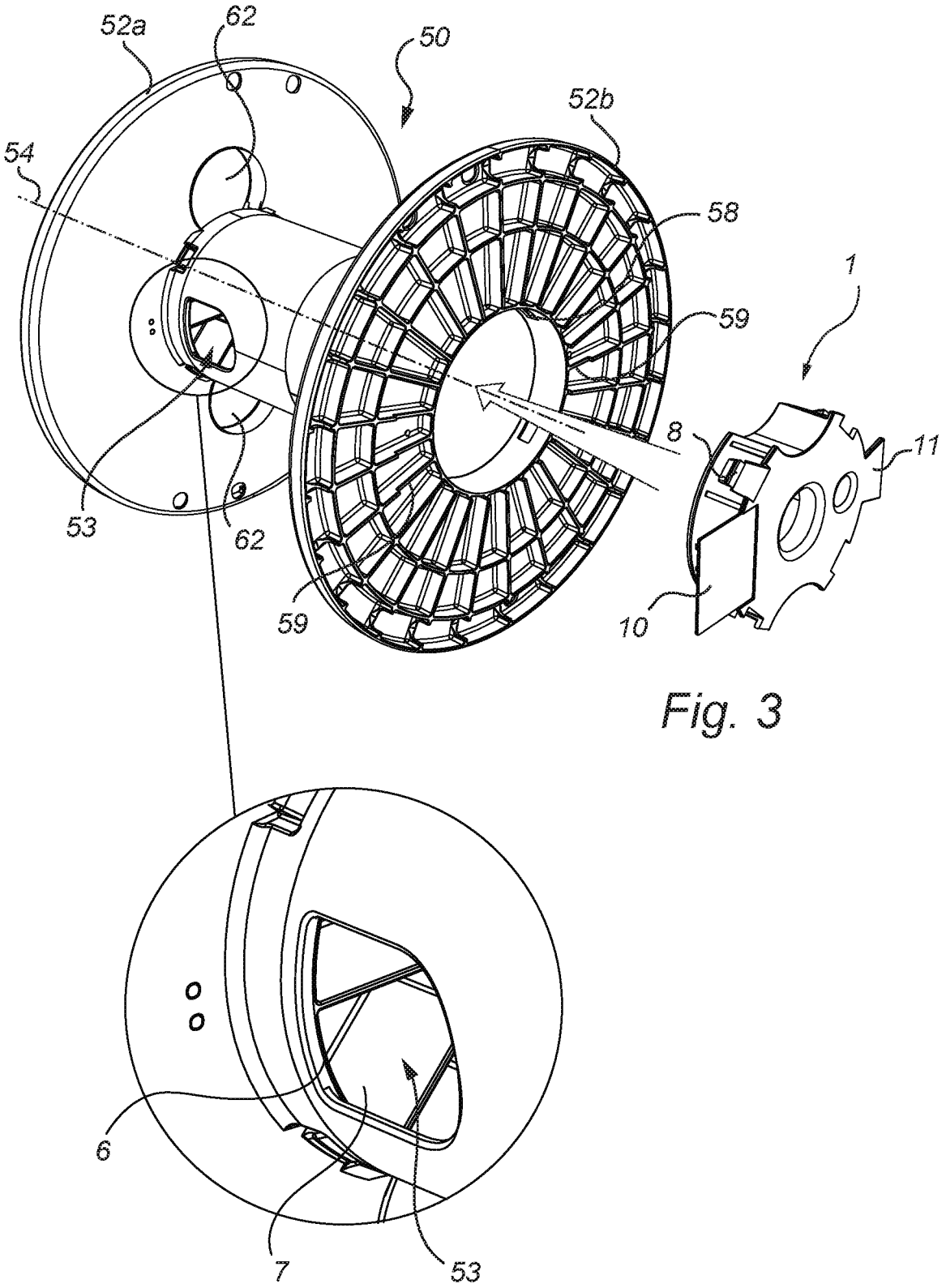
FIG. 3 illustrates the plastic cap for a cable spool in FIGS. 1 and 2 and a cable spool to which the plastic cap should be attached.
Figure 4:
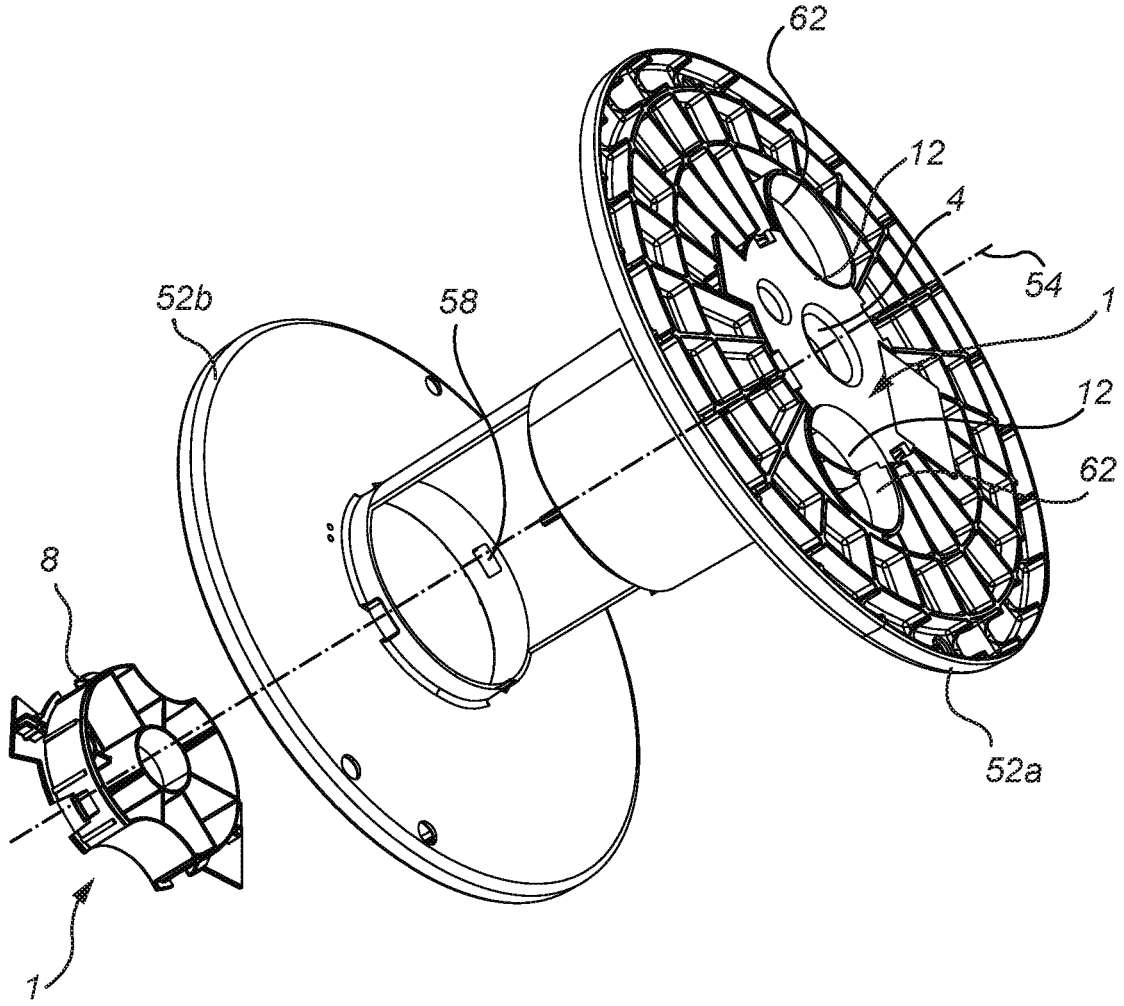
FIG. 4 illustrates the cable spool in FIG. 3 from another view, in partly broken view, and with one plastic cap provided thereon.

FIGS. 1 and 2 illustrate a plastic cap 1 to be used with a plastic cable spool 50. The cable spool 50 is illustrated in FIGS. 3 and 4. Such a cable spool 50 comprises a barrel 51 and two flanges 52*a*, 52*b*. One of the flanges 52*a* is provided with through-holes 62, which serves as start holes. Hence, they are intended to receive a cable to be wound around the barrel. The start holes extend from an inward facing side to an outward facing side of the cable spool. When cable is to be wound onto the cable spool, the cable is passed through the start hole from the inward facing side to the outward facing side, where it is then held in place as the cable spool is rotated, thus causing the cable to be winded onto the cable spool.

Even if there are differences between the two flanges 52*a*, 52*b*, it is intended that the same cap 1 can be attached to either one of the flanges.

The cap 1 comprises a back side 2 adapted to be arranged towards either one of the flanges 52*a*, 52*b* and the barrel 51 of the plastic cable spool 50 and a front side 3 adapted to be directed away from either one of the flanges 52*b* and the barrel 51 of the plastic cable spool 50.

The cap 1 is provided with a through-hole 4 adapted to be aligned with a center axis 54 of the cable spool 50. As can be best seen in FIG. 2, the through-hole 4 is surrounded by an inner wall 5 on the back side 2 of said cap 1. The cap is also provided with an outer wall 6 extending around at least a part of said outer circumference of said cap, on the back side of said cap. The cap in this embodiment is also provided with eight reinforcement ribs 7 extending between said outer wall 6 and said inner wall 5. The height of the reinforcement ribs 7 is uniform throughout their extension between the outer wall 6 and the inner wall. The height of the outer wall 6 and the height of the inner wall 5 is also the same as the height of each one of the reinforcement ribs 7, except one, and in this embodiment, the height is approximately 50 mm.

The cap is also provided with a through-hole 14 functioning as a drive hole. The drive hole 14 is provided such that it intersects one of the reinforcement ribs 7, namely the one having a lower height than the others, and is surrounded by a second inner wall 15.

On the outer side of the outer wall 6, the cap is provided with four integral attachment means 8 adapted for snap-fitting the plastic cap 1 to corresponding attachment means 58 at either one of the flanges 52*a*, 52*b* of the cable spool 50. The plastic cap may thereby be securely held to the cable spool.

The cap 1 is also provided with two rotational locks 9 adapted for rotationally locking the cap in relation to the cable spool 50. The rotational locks fulfill their purpose when the cap 1 is attached to the cable spool by said integral attachment means 8 by interaction between the rotational locks 9 and corresponding ribs 59 provided on the flanges 52*a*, 52*b*. As is clearly seen in the drawings, the rotational lock 9 is a separate component from the integral attachment means 8.

Each of the rotational locks consists of two plastic parts 9*a*, 9*b* being provided parallel to each other and being distanced approximately 3 mm from each other. The plastic parts have a length of approximately 14 mm and a height of approximately 13 mm.

The rotational locks are provided on a respective flange 10, 11. The flanges 10, 11 are provided so that they are connected to a respective portion of the periphery of the circumference of the cap and at diametrically opposed sides of said cap. Hence, they extend outside the outer wall 6 of the cap. The flanges are not uniformly sized and shaped and the reason for this is that a user of the cable spool should be able to use the larger of the two flanges as a place to display, e.g. by means of a sticker or paint, his/her logo or company name. Also, other types of information may be displayed thereon. The smaller of the two flanges is arranged to be fitted between two ribs 59 in order to provide additional rotational locking. The rotational locks 9 are however provided at the same distance from the center of the through-hole 4. In this embodiment, the distance between each one of the rotational locks 9 and the center of the through-hole 4 of the cap is approximately between 6.5 and 7.5 cm. The distance is measured from the part of the rotational lock being closest to through-hole 4.

As is seen in FIGS. 1 and 2, the cap 1 has a generally circular outline, excluding the two flanges 10, 11 and on two diametrically opposed sides, there is provided concave recesses 12. The concave recesses are provided such that there is an angle of approximately 90° between the center of each one of the concave recesses and the center of each one of the two flanges 10, 11. As is also seen in the figures, the recesses extend in a plane perpendicular to the front and back side of the cap. Hence, when the cap is viewed from e.g. its front side, the recesses extend towards the center of cap. Each one of the concave recesses has a distance of approximately 5 and 6 cm between its edges. As can be seen in FIG. 2, the outer wall 6 follows that shape of the concave recesses.

When the cap 1 is attached to the flange 52*a* of the cable spool 50, the concave recesses 12 are positioned so that they co-operate with the start holes 62 of the flange 52*a*. The outer wall 6 then serves as a reinforcement of the start holes.

The cap 1 is on its front side provided with means 13 for enabling identification of the cap by a vision camera. In this embodiment, these means are provided as an area surrounding the through-hole 4 of the cap 1. The means 13 for enabling identification of the cap 1 by a vision camera is in this embodiment a surface structure differing from the surface structure of the remaining cap. It may however also be e.g. a color differing from the color of the remaining cap or a or a pattern differing from the pattern of the remaining cap, or a combination of either two or three of the different color, surface structure and pattern.

The purpose of this means 13 is to enable a robot provided with a vision camera to identify and pick the cable spool from its storage position and place it in e.g. a winding machine. As the robot may use the through-hole 4 to insert a holding means in order to lift the cable spool, it is advantageous to provide the means 13 for identification by a vision camera to surround said through-hole.

As is also seen in FIGS. 3 and 4, the barrel 51 is provided with a through-hole 53. The through hole 53 is provided at such a distance from the flange 52*a* of the cable spool that is provided with the cap 1, that the part of the through-hole 53 being closest to the flange 52*a* is flush with the outermost part of the outer wall 6 of said cap. The purpose of the trough-hole 53 is to function as a start hole for winding machines of a configuration where the start hole is provided on the barrel. Hence, the cable spool according to this embodiment may function with different types of winding machines.

The skilled person realizes that a number of modifications of the embodiments described herein are possible without departing from the scope of the invention, which is defined in the appended claims.

For example, the present invention has been described in relation to a cable spool. It can however also be employed in for example a cable spool and/or a cable drum.

The cap has been described as comprising eight reinforcement ribs, it is however also conceivable to provide it with e.g. four, six or ten reinforcement ribs.

The invention claimed is:

1. A cap to be used with a plastic cable spool, said cap comprising a back side adapted to be arranged towards a barrel of the plastic cable spool and a front side adapted to be directed away from the barrel of the plastic cable spool, wherein said cap has a through-hole adapted to be aligned with a center axis of the cable spool, wherein said through-hole is at least partly surrounded by an inner wall on the back side of said cap, wherein said cap is provided with an outer wall extending around at least a part of an outer circumference of said cap, on the back side of said cap, wherein said back side of said cap is provided with at least four reinforcement ribs extending between said outer wall and said inner wall, and wherein the cap is provided with two rotational locks adapted for rotationally locking said cap in relation to the cable spool wherein each one of said rotational locks is provided on a respective flange extending outside said outer wall of said cap.

2. A cap according to claim 1, wherein the height of said reinforcement ribs is uniform throughout their extension between said outer wall and said inner wall.

3. A cap according to claim 1, wherein the height of said outer wall and the height of said inner wall is the same as the height of said reinforcement ribs.

4. A cap according to claim 1, wherein the height of said reinforcement ribs are in the range of 30-70 mm.

5. A cap according to claim 1, wherein the cap is provided with integral attachment means adapted for snap-fitting the plastic cap to the cable spool.

6. A cap according to claim 1, wherein the two rotational locks are provided on the respective flanges at diametrically opposed sides of said cap.

7. A cap according to claim 1, wherein the cap has a generally circular outline, and is provided with two diametrically opposed concave recesses.

8. A cap according to claim 7, wherein the concave recesses each has a distance in the range of 4-7 cm.

9. A cap according to claim 1, wherein the through-hole of said plastic cap is, on the front side of said cap, surrounded by an area provided with means for enabling identification of the cap by a vision camera.

10. A cap according to claim 9, wherein said means for enabling identification of the cap by a vision camera is either a color differing from the color of the remaining cap or a surface structure differing from the surface structure of the remaining cap or a pattern differing from the pattern of the remaining cap, or a combination of either two or three of the different color, surface structure and pattern.

11. A cable spool comprising a barrel and two flanges, wherein one of said flanges is provided with a cap according to claim 1.

12. A cable spool according to claim 11, wherein said cable spool is made in one piece.

13. A cable spool according to claim 11, wherein said barrel is provided with a through-hole, wherein said through-hole is provided at such a distance from one of the flanges of the cable spool being provided with said cap, that the part of the through-hole being closest to the flange is flush with the outermost part of the outer wall of said cap.

* * * * *